United States Patent [19]

Morris et al.

[11] Patent Number: 4,459,472

[45] Date of Patent: Jul. 10, 1984

[54] ELECTRIC HEATING APPARATUS

[75] Inventors: Kenneth Morris, Hockley; Harry J. J. Wrenn, Hawkwell; Andrew C. Richardson, Welwyn Garden City, all of England

[73] Assignee: Electrothermal Engineering Limited, Essex, England

[21] Appl. No.: 476,232

[22] Filed: Mar. 17, 1983

[30] Foreign Application Priority Data

Apr. 5, 1982 [GB] United Kingdom ..... 8210090

[51] Int. Cl.[3] ..... H05B 3/34

[52] U.S. Cl. ..... 219/535; 219/430; 219/433; 219/460; 219/521; 219/531

[58] Field of Search ..... 219/345, 385, 430, 432, 219/433, 439, 521, 531, 535, 548, 460, 462, 464, 424, 415, 400

[56] References Cited

U.S. PATENT DOCUMENTS

| | | | |
|---|---|---|---|
| 2,607,876 | 8/1952 | Bergen et al. | 219/535 X |
| 2,739,221 | 3/1956 | Morey | 219/535 X |
| 3,646,321 | 2/1972 | Siegler | 219/464 |
| 3,798,418 | 3/1974 | Reik et al. | 219/535 |
| 4,249,069 | 2/1981 | Anderson | 219/535 |

FOREIGN PATENT DOCUMENTS

| | | | |
|---|---|---|---|
| 447768 | 4/1948 | Canada | 219/535 |
| 2201604 | 7/1973 | Fed. Rep. of Germany . | |
| 3006679 | 8/1981 | Fed. Rep. of Germany . | |
| 53905 | 1/1947 | France | 219/460 |
| 430984 | 8/1967 | Switzerland | 219/460 |
| 623786 | 5/1949 | United Kingdom | 219/535 |
| 713653 | 8/1954 | United Kingdom . | |
| 1350994 | 4/1974 | United Kingdom . | |

*Primary Examiner*—Volodymyr Y. Mayewsky
*Attorney, Agent, or Firm*—Merchant, Gould, Smith, Edell, Welter & Schmidt

[57] ABSTRACT

There is disclosed an electric heating apparatus comprising a pre-formed body of thermally insulating material defining a cavity for receiving a vessel whose contents are to be heated, the body being provided with an electric heating element in or adjacent the cavity for heating such a vessel in use of the apparatus. The apparatus further comprises a housing in which the body is disposed with an air space between the body and the housing, the latter having openings so that convection air currents can flow through the air space in use of the apparatus for extracting heat via the air space.

8 Claims, 2 Drawing Figures

Figures 1, 2:
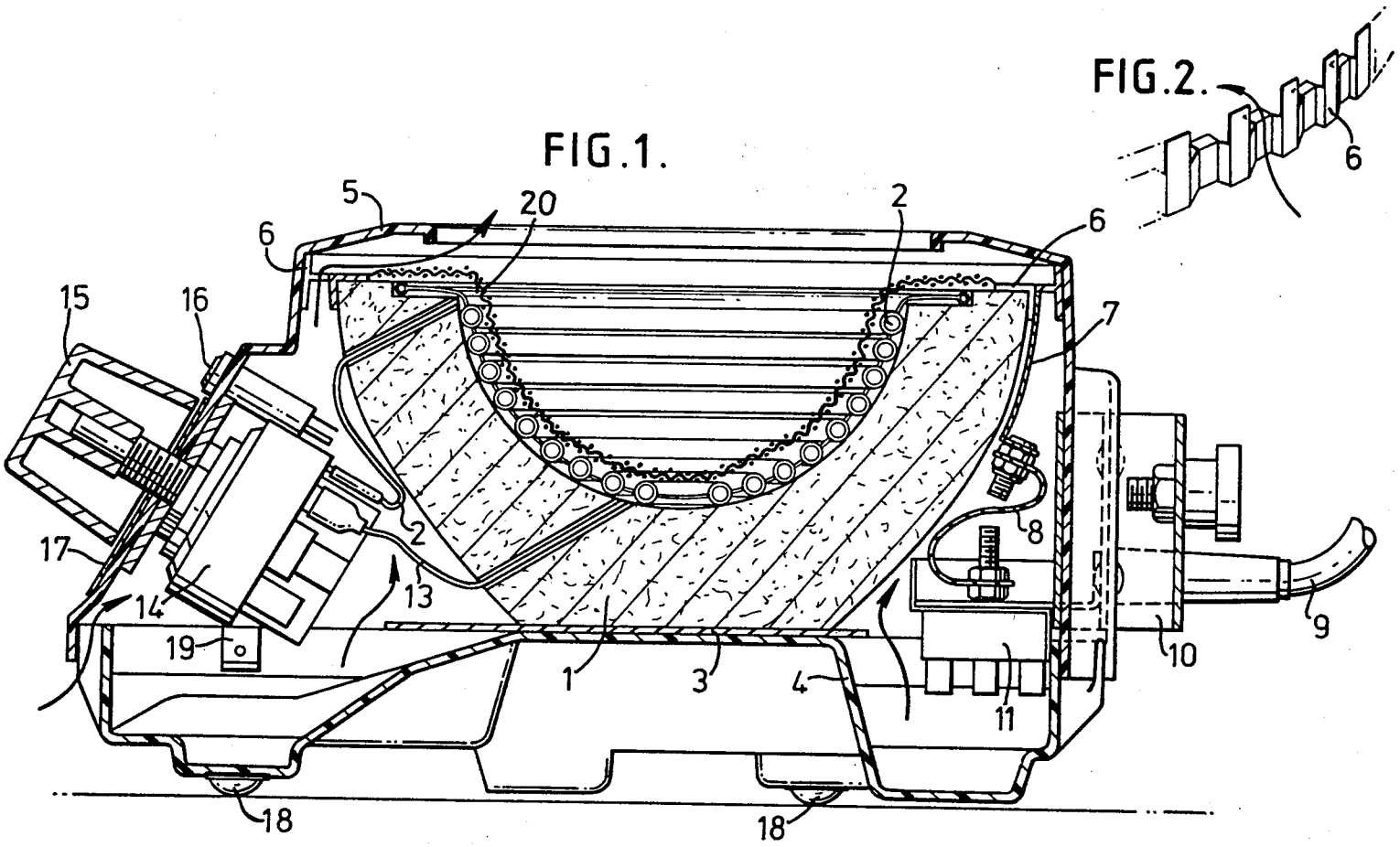

1
2
3
4
5
6
7
8
9
10
11
13
14
15
16
17
18
19
20

ELECTRIC HEATING APPARATUS

The present invention relates to an electric heating apparatus.

British Patent Specification No. 1,350,994 discloses an electric heating mantle comprising a cup-shaped layer of high temperature, low conductivity thermal insulation defining a cavity for receiving a vessel whose contents are to be heated, a layer of metal gauze forming a lining for the cavity and an electric heating element situated close to the cavity lining. On the opposite side of the cup-shaped layer from the cavity, there is a covering of heat-reflective foil and the layer and its covering are received in a housing with a mass of standard thermal insulation in which the layer and the covering are embedded between them and the housing.

It is the object of the present invention to provide an electric heating apparatus which includes a body of thermally insulating material defining a cavity for receiving a vessel whose contents are to be heated, the body being provided with an electric heating element in or adjacent the cavity and being in a housing, in which the method of reducing the transmission of heat to the housing is simpler and cheaper than in the above British patent specification.

According to the present invention, there is provided an electric heating apparatus comprising a pre-formed body of thermally insulating material defining a cavity for receiving a vessel whose contents are to be heated, the body being provided with an electric heating element in or adjacent the said cavity for heating such a vessel in use of the apparatus, the apparatus further comprising a housing in which the said body is disposed with an air space between the body and the housing, the latter having openings so that convection air currents can flow through the said air space in use of the apparatus for extracting heat via the said air space.

The present invention will now be described, by way of example, with reference to the accompanying drawing, in which:

FIG. 1 is a cross-section through one example of an electric heating apparatus according to the present invention; and FIG. 2 is a detail of one of the components of the apparatus.

Referring to FIG. 1, an electric heating apparatus comprises a moulded pre-formed body 1 of thermally insulating material, more particularly a pre-formed body made by moulding amorphous alumino silicate ceramic fibres such as those manufactured by McKechnie Refractory Fibres Limited of P.O. Box 4, Widnes, Cheshire, WA8 OPG, England. The body 1 defines a part-spherical cavity for receiving a vessel whose contents are to be heated, the cavity being lined with a flexible electric heating element 2 for heating such a vessel in use of the apparatus. The body 1 is disposed on a heat sink 3 on a base 4 of the apparatus, the base 4 being made of a thermoplastic plastics material such as polypropylene. The body 1 is in a housing 5 also made of a thermoplastic plastics material such as polypropylene. There is an air space between the body 1 and the housing 5 and the latter is open at its bottom and its top so that convection air currents can flow through the air space as shown by the arrows in use of the apparatus for extracting heat from the heat sink 3 and the surface of the body 1 remote from the cavity.

The body 1 is spaced relative to the housing 5 by a castellated metal ring 6, whose shape is more particularly shown in FIG. 2, this shape permitting the flow of the above-mentioned convection air currents. For safety purposes, the ring 6 is connected to earth via a metal member 7 and a conductor 8 and thence to the earth lead of an input power cable 9, reference numeral 10 denoting a clamp assembly for the cable 9 and reference numeral 11 denoting a fuse, fuseholder and terminal block assebly (which assembly is removable for replacement of the body 1 and/or the element 2).

Current is passed through the heating element 2 via conductors 12 and 13, reference numeral 14 denoting a rheostat having a control knob 15 for controlling energisation of the element 2. Reference numeral 16 denotes one of two neons for indicating respectively that the main supply to the apparatus is on and that the heater is being energised. Reference numeral 17 denotes a fascia plate, reference numerals 18 denote rubber feet of the base 4 and reference numeral 19 denotes a base 4 to housing 5 fixing.

For added safety (for example when wet vessels are being handled) there could be in the cavity outside the element 2 (and therefore between the element 2 and a vessel in use of the apparatus) a cup made from metal mesh or expanded or perforated metal, which cup is connected to or integral with the ring 6 and is therefore earthed.

In a modified form of the apparatus, there is a hole through the centres of the heating element 2 and the body 1, aligned with a hole through the base 4, so that a funnel can be received in the cavity between the element 2 (or the metal cup, if provided) and a vessel being heated, with the spout of the funnel passing through the above-mentioned holes to act as a drain.

We claim:

1. An electric heating apparatus comprising:

(a) a pre-formed body of thermally insulating material defining a cup-shaped cavity for receiving a vessel whose contents are to be heated;

(b) an electric heating element lining the said cavity for heating such a vessel in use of the apparatus;

(c) a housing defining upper and lower openings, in which housing the said body is disposed with an air space between it and the housing so that convection air currents can flow through the said air space in use of the apparatus for extracting heat via the said air space; and (d) an electrically conductive member extending circumferentially around the outer periphery of the said body and connected to a point which is at earth potential in use of the apparatus, the member comprising inner portions alternating with outer portions, each of the inner portions being connected by transverse portions of the member to the adjacent outer portions, the inner portions being in contact with the outside of the body and the outer portions being in contact with the housing, the member spacing the said body from the housing and providing spaces between its inner and outer portions for the passage of such air currents between the member and the housing on their way between the said openings.

2. Apparatus according to claim 1, wherein the body comprises moulded ceramic material.

3. Apparatus according to claim 1, wherein the body is on a heat sink in the housing.

4. Apparatus according to claim 1, wherein the housing is made from plastics material.

5. Apparatus according to claim 4, wherein the plastics material is a thermoplastics material.

6. Apparatus according to claim 5, wherein the plastics material is polypropylene.

7. Apparatus according to claim 1, wherein the said member is around the top of the body.

8. Apparatus according to claim 1, further comprising a cup of electrically conductive material in the cavity and outside the heating element, and shaped for receiving a vessel, the cup being integral or electrically connected with the said member.

* * * * *